US005323921A

United States Patent [19]

Olsson

[11] Patent Number: 5,323,921

[45] Date of Patent: Jun. 28, 1994

[54] CONTAINER

[75] Inventor: Elov Olsson, Alfta, Sweden

[73] Assignee: Nefab AB, Alfta, Sweden

[21] Appl. No.: 952,715

[22] PCT Filed: May 23, 1991

[86] PCT No.: PCT/SE91/00367

§ 371 Date: Nov. 25, 1992

§ 102(e) Date: Nov. 25, 1992

[87] PCT Pub. No.: WO91/18794

PCT Pub. Date: Dec. 12, 1991

[30] Foreign Application Priority Data

May 25, 1990 [SE] Sweden ..... 9001887

[51] Int. Cl.[5] ..... B65D 7/24

[52] U.S. Cl. ..... 217/12 R; 220/6; 220/7

[58] Field of Search ..... 220/6, 7; 217/12

[56] References Cited

U.S. PATENT DOCUMENTS

| | | | |
|---|---|---|---|
| 964,121 | 7/1910 | Rose | 220/7 |
| 2,868,406 | 1/1959 | Kookogey | 220/7 |
| 3,809,278 | 5/1974 | Csumrik | 220/7 |

*Primary Examiner*—Joseph Man-Fu Moy
*Attorney, Agent, or Firm*—Cohn, Powell & Hind

[57] ABSTRACT

A foldable container comprises a bottom member (1), a foldable wall arrangement (2) and a lid (3). A locking arrangement included in the container and having locking means (7) on the lid and/or locking means (8) on the bottom member is arranged to interlock the lid and the bottom member in the folded state of the container in a position, in which they are located substantially closer to each other than when the container is filled. The lid and the bottom member form a space therebetween in the interlocked state, in which space the folded wall arrangement may be received.

27 Claims, 5 Drawing Sheets

CONTAINER

TECHNICAL FIELD OF THE INVENTION AND PRIOR ART

This invention relates to a container of the type comprising a bottom, a foldable wall arrangement and a lid. The container may have the character of a box, receptacle etc. with very varying size and is intended to be used for transport and storage of goods of very varying types.

Such containers have to be foldable so as to occupy a minimum of space during transport without goods or storage. According to the prior art the lid, the bottom and the wall arrangement are present as separated elements in the folded state of the container. These elements are generally arranged in big numbers in any suitable container for transport or storage. However, this incurs according to the experience considerable troubles to once again unfold or erect the different containers, since one has to select container elements fitting together from a greater collection of elements, which furthermore may contain containers of different sizes. The problem is accentuated by the fact that often separate elements or even a bigger number of the same may be lost during transport or storage. Furthermore, there is a considerable risk of damages of the container elements, and in particular their edge garnitures and interlocking means, when the elements are transported or stored disordered upon each other in stacks.

SUMMARY OF THE INVENTION

The object of the present invention is to point out constructive ways to reduce the problems mentioned above and accordingly provide a container with improved properties for transport and storage and a reduced risk of damages in the folded state.

This object is in accordance with the appended claim 1 obtained by that a locking arrangement included in the container and having locking means on the lid and/or on the bottom member is arranged to interlock the lid and the bottom member in the folded state of the container, and that the lid and the bottom member form a space therebetween in the interlocked state, in which the folded wall arrangement may be received. Thus, all elements of the container will in accordance herewith form a continuous unit in the folded state of the container, so that when the container has to be unfolded again after transport or storage, the operator knows for sure that the elements held together belong to one and the same container. It will of course primarily be the wall arrangement that get a protected position through the interconnection, but besides that will also the lid and the bottom be to a smaller extent exposed to damages as if they were completely separated.

The object aimed at is in accordance with the solution defined in claim 14 obtained in a container, which on the lid has locking means so as to cooperate with the wall arrangement for interlocking the lid and the wall arrangement in the unfolded state of the container, by that the locking means arranged on the lid are also arranged to cooperate with the bottom member so as to interlock the lid and the bottom in a position when the wall arrangement is removed or folded, said lid and bottom being substantially closer to each other in this position than when the container is unfolded. Thus, the problems mentioned in the introduction will also here be reduced by that the lid and the bottom are interlockable during transport and storage, and a particularly remarkable feature is the fact that the same locking means, which in the unfolded state of the container serves to interlock the lid and the wall arrangement, also serves to interlock the lid and bottom in the folded state of the container. This multiple use of the same locking means for fulfilling to locking tasks leads to a comparatively simple and uncomplicated construction. Although, it would be possible to transport and store the folded wall arrangement as mechanically not held together with the interlocked unit formed by the lid and the bottom within the scope of claim 14, there is also an improvement to enclose the folded wall arrangement in a space between the interlocked lid and bottom elements.

Advantageous developments of the invention are objects of the dependent claims.

BRIEF DESCRIPTION OF THE DRAWINGS

With reference to the appended drawings, below follows a specific description of an embodiment of the invention cited as an example.

In the drawings.

DETAILED DESCRIPTION OF A PREFERRED EMBODIMENT

Figure 1:
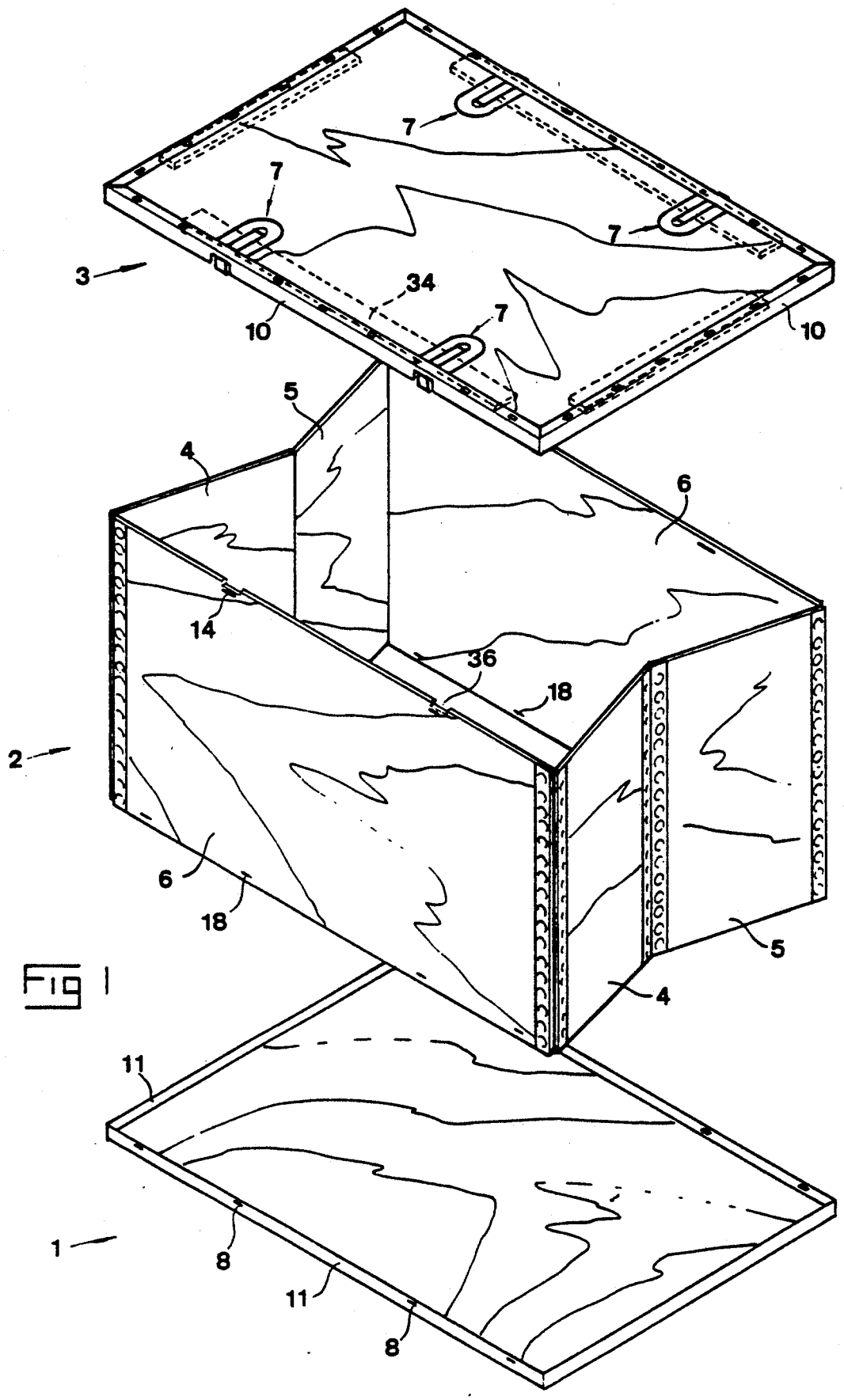
FIG. 1 is an exploded perspective view illustrating the container.

The container illustrated in FIG. 1 comprises a bottom member 1, a foldable wall arrangement 2 and a lid 3. The container has in the example a parallelepipedic basic form. The wall arrangement 2 is in the unfolded state of the container locked with respect to the bottom member 1 in a way which will be described hereinafter, and the lid 3 is securable to the wall arrangement 2 while closing the container. The lid and the bottom member as well as the wall arrangement may in the practice consist of sheets of plastic, plywood or the like and edge- and corner garniture of metal secured thereto.

Figure 2:
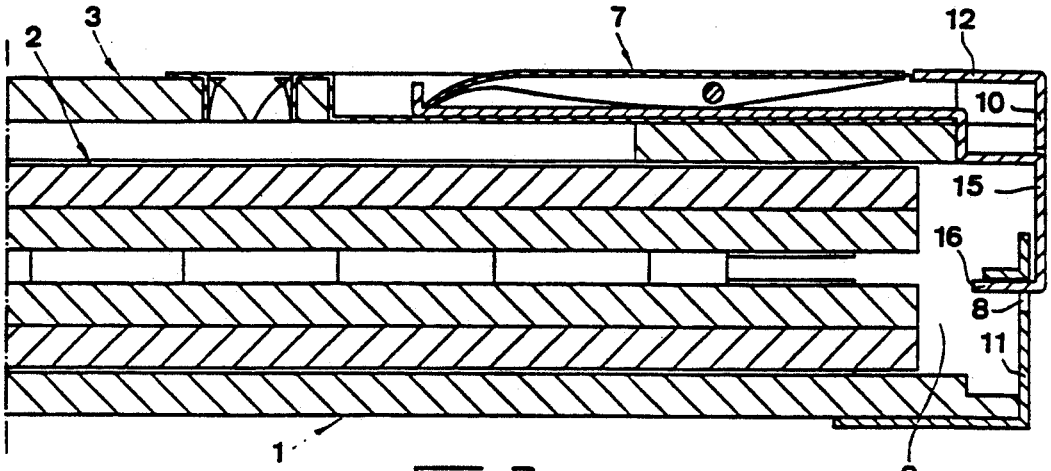
FIG. 2 is a cross section through a portion of the container in its folded state.

The wall arrangement 2 has in the four corners thereof hinge armatures and furthermore two opposite walls of the wall arrangement are divided into two hingedly interconnected members 4, 5, which in their turn are hingedly connected to the other walls 6 of the wall arrangement 2. The wall arrangement 2 is by that foldable by pivoting the wall members 4, 5 inwardly towards the centre of the wall arrangement at the same time as the walls 6 are moving towards each other as slightly indicated in FIG. 1. The walls 6 and the wall members 4, 5 will be directed substantially parallelly while forming a comparatively thin package (see the middle of FIG. 2) in the completely folded state of the wall arrangement 2. A locking arrangement included in the container and having locking means 7 on the lid and locking means 8 on the bottom member is arranged to interlock the lid and the bottom member in the folded state of the container (FIG. 2). The lid 3 and the bottom member 1 form a space 9 therebetween in the interlocked state, in which space the folded wall arrangement 2 may be received.

Figure 3:
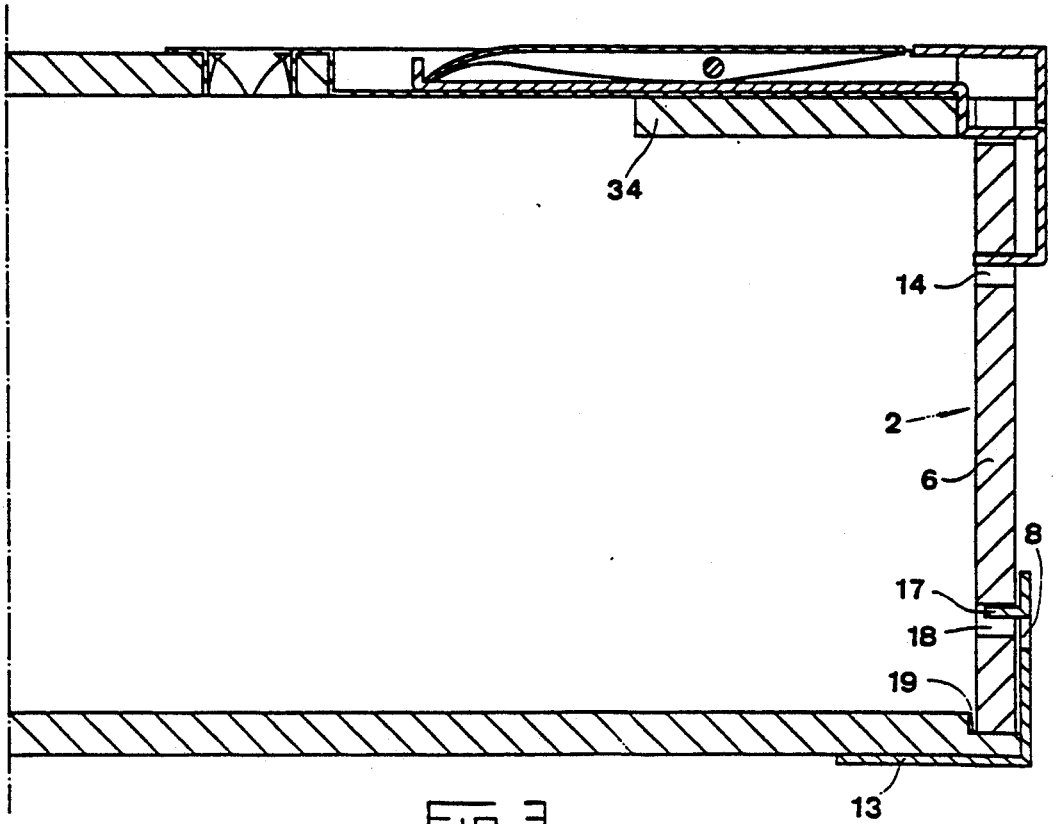
FIG. 3 is a cross section corresponding to the one in FIG. 2 but illustrating the unfolded container.

As appears from FIG. 2, the lid and the bottom member form a substantially closed box in their interconnected state, the volume of said box being mainly predetermined by the location of the locking means 7, 8 and their mutual engagement and substantially smaller than the volume of the container in its unfolded state. The standing wall of the box in this state is formed by the edge flanges 10, 11 of the lid 3 and the bottom member 1. These edge flanges 10, 11 extend preferably around the whole periphery of the lid and the bottom member and substantially perpendicularly to the planes thereof. The edge flanges are preferably parts of bosoms suitably consisting of metal and extending along the edges of the lid 3 and the bottom member 1, the second flange 12, 13 of said bosoms being secured upon and under, respectively, sheets included in the lid and bottom member, which appears most clearly from FIG. 2 and 3. These edge armatures may be fixed to the sheets by means of fastening lugs punched out of the second flanges or other suitable fixing means.

It should be inserted that the bottom member 1 of course may have additional members on its lower side, such as feet or support beams, for bearing upon an underlayer and for allowing the introduction of suitable handling means, for instance lifting forks, under the bottom member.

The locking means 7 on the lid 3 are arranged to interconnect the lid and the wall arrangement 2 in the unfolded state of the container by entering into engagement with corresponding locking means 14 on the wall arrangement. It is preferred that the locking means 7 on the lid 3 comprise a suitable number, in the example 4, of locking devices 7, each of which having a moveable locking member 15.

The locking means on the bottom member 1 comprise a recess 8 for receiving a portion 16 of the locking member 15 for each of the locking devices 7. Furthermore, it is preferred that the locking means on the wall arrangement 2 comprise a recess 14 for receiving the portion 16 of the locking member 15 of the locking device in question for each of the locking devices 7.

As it appears from FIG. 1, two locking devices 7 and recesses 8 and 14, respectively, corresponding thereto are arranged along two opposite sides of the container, more exactly along that sides, which are not associated with the divided walls 4, 5 of the wall arrangement. It is preferred that each of the recesses 8 in the bottom member 1 is formed by folding a portion 17 (see FIGS. 2 and 3) of the edge flange 11 of the bottom member outwardly in the direction towards the interior of the container, and that a portion 17 folded out form further locking means, which by cooperating with corresponding locking means 18 on the wall arrangement serve to hold the wall arrangement 2 and the bottom member 1 together in the unfolded state of the container. The portion 17 folded out is advantageously formed by a combined punching/bending operation and has the character of a tongue directed inwardly into the container. The additional locking means 18 has the character of recesses made in the wall 6 of the wall arrangement. As it appears from especially FIG. 3, the bottom member 1 has suitably a countersink 19 along its peripheral edges but inside the edge flange 11, in which countersink the lower edge of the walls of the wall arrangement 2 may fall down when the wall arrangement is completely unfolded. The recesses 18 have a vertical width sufficient to allow the lower edges of the wall arrangement to sink down in the countersinks at the end of the unfolding thereof. The inner edges of the countersinks 19 constitute after that obstacles preventing the wall arrangement 2 from being unintentionally folded.

The locking member 15 is moveable to and fro with respect to a body 20 of the locking device 7 substantially parallelly to the plane of the lid 3 between a first position (FIG. 2–5 and 7), in which the portion 16 of the locking member is receivable in the recess 14 or 8 of the wall arrangement 2 and the bottom member 1, respectively, when the lid is placed on the wall arrangement or the bottom member, and a second position (FIG. 6), in which the portion of said locking member is located outside the recess 14 and 8, respectively, and outside the wall arrangement or the bottom member. Expressed in another way, the locking member 15 is arranged to get into engagement into the respective recess 14, 8 through its portion 16 from the outside of the wall arrangement and the bottom member. The locking member 15 has to this end a portion 21 extending substantially parallelly to the plane of the lid 3, the end of said portion located closest to the outer edge of the lid is bent and has outermost a portion 16 extending backwardly substantially parallelly to the portion 21. The bending may comprise a number of bending zones resulting in a downwardly extending portion 22, an outwardly extending portion 23 followed by a further downwardly extending portion 24 and finally the end portion 16 in the direction from the portion 21 to the portion 16.

Figure 6:
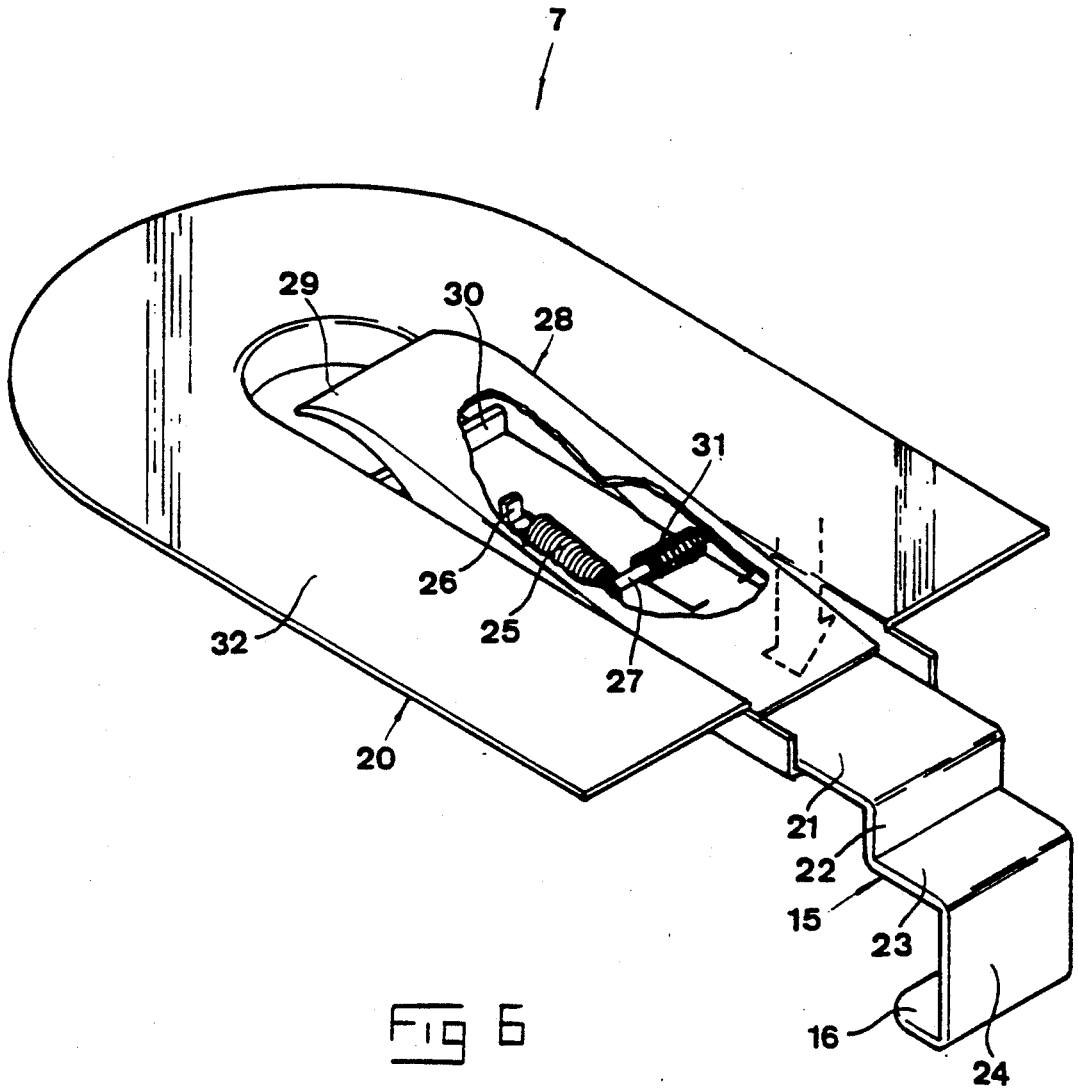
FIG. 6 is a perspective partially sectioned view of a locking device arranged on the lid seen obliquely from above and FIG. 7 is a view of the locking device seen obliquely from below/from the rear.
Figure 7:
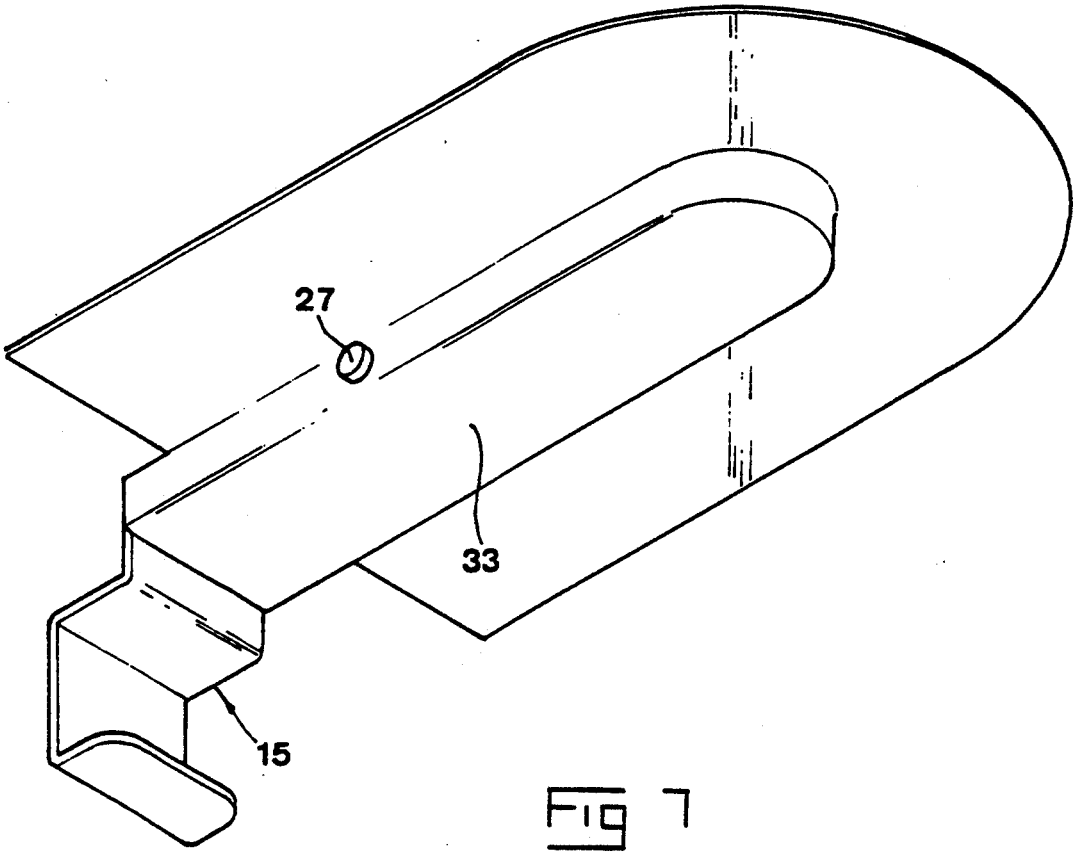

The locking member 15 is by means of a first spring 25 influenced in the direction towards its second position according to FIG. 6. This spring 25, for instance in the form of a tension spring with helical form, acts between a bracket 26 on the locking member 15 and a bracket 27 with respect to the body 20 of the locking device.

An operating member 28 is pivotally mounted with respect to the body about an axis directed substantially transversal to the direction of movement of the locking member 15 and arranged to lockingly cooperate with the locking member 21 by means of a portion 29 for holding it in the first position thereof (for example FIG. 2 and 3) against the action of the spring 25. Said axle may also be given a designation 27, since it also functions as the bracket already mentioned for the spring 25 with respect to the body.

A locking member 15 has a stop 30, for instance formed by a bent end portion 30 of the locking member 15 at the end opposite to the locking portion 16, for cooperation with the locking portion 29 of the operating member 28.

The operating member 28 is by means of a second spring 31 influenced towards its locking pivot position and the operating member may be pivoted by manual action from this locking position so as to release the locking member. The operating member 28 has in the practice the character of a double-armed lever, on one arm of which the locking portion 29 is arranged and the other arm of which may be manually influenced according to the dashed arrow in FIG. 6 against the action of the spring 31 so as to release the locking member, so that this is pulled by the spring 25 to its second position.

The spring 31 may for example be an helical spring arranged around the axle 27 with a first end portion pressing against the operating member 28 and a second end portion pressing against the upper side of the portion 21 of the locking member 15. Thus, the locking member 15 is intended to be manually pushed to its first position against the action of the spring 25, in which position the portion 16 is entered into engagement in the recess 14 and 8, respectively.

It is preferred that the body 20 of the locking device has a substantially flat flange 32 arranged to appear against the upper side of the sheet of the lid. The fixing of the locking device to this sheet may suitably be accomplished in a way appearing from FIGS. 2, 3 and 5, namely by providing punchings forming fastening lugs in the flange 32, said fastening lugs penetrating into the sheet. Furthermore, it is preferred that the body 20 of the locking device has a countersinked centre portion 33 (FIG. 7), which forms a guiding slot, in which the portion 21 of the locking member 15 is movably guided. The axle 27 passes suitably through the slot and through the sides of the countersink, said operating member 28 may at least partially have an U-shaped cross section with the legs directed downwardly and penetrated by the axle 27, so that the base of the U accordingly will form an envelope over the springs 25, 31. Recesses corresponding to the countersinks 33 of the locking device 7 are made in the sheet of the lid 3. As it appears from FIG. 2 and 3, the locking device 7 is designed in such a manner that it not or only slightly protrude above the upper surface of the lid 3 at the side of the locking means. It is indicated by dashed lines in FIG. 1 and further illustrated in FIG. 2 and 3 that disc pieces or ribs 34 extending along the edges of the lid are arranged on the underside of the lid 3, said disc pieces or ribs forming grooves extending around at least a considerable part of the periphery of the lid between themselves and the adjacent edge flange 10 so as to prevent the walls from divert inwardly into the container, and the edge flange 10 prevents deviations outwardly from taking place by externally grasping the upper edges or borders of the wall arrangement.

Figure 4:
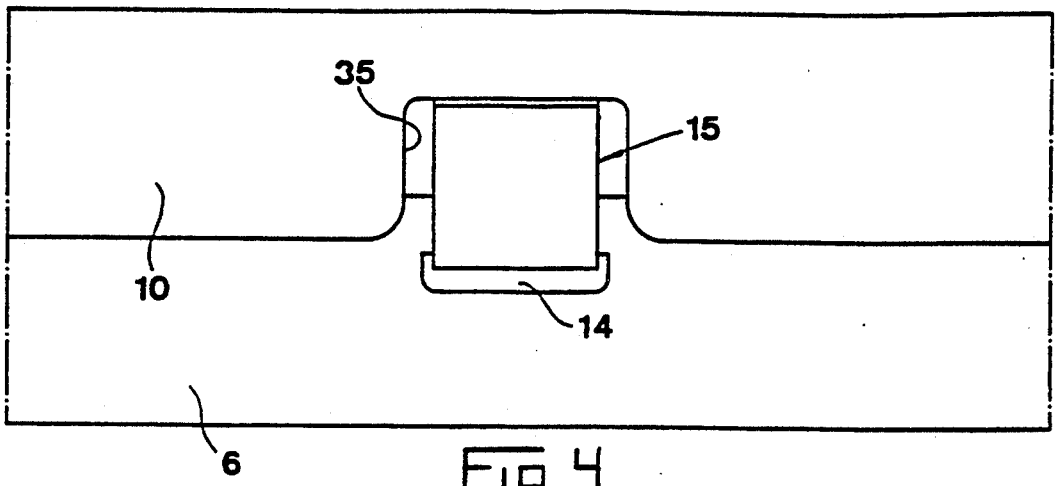
FIG. 4 is a front view of a locking member and illustrates the engagement thereof in the wall arrangement.
Figure 5:
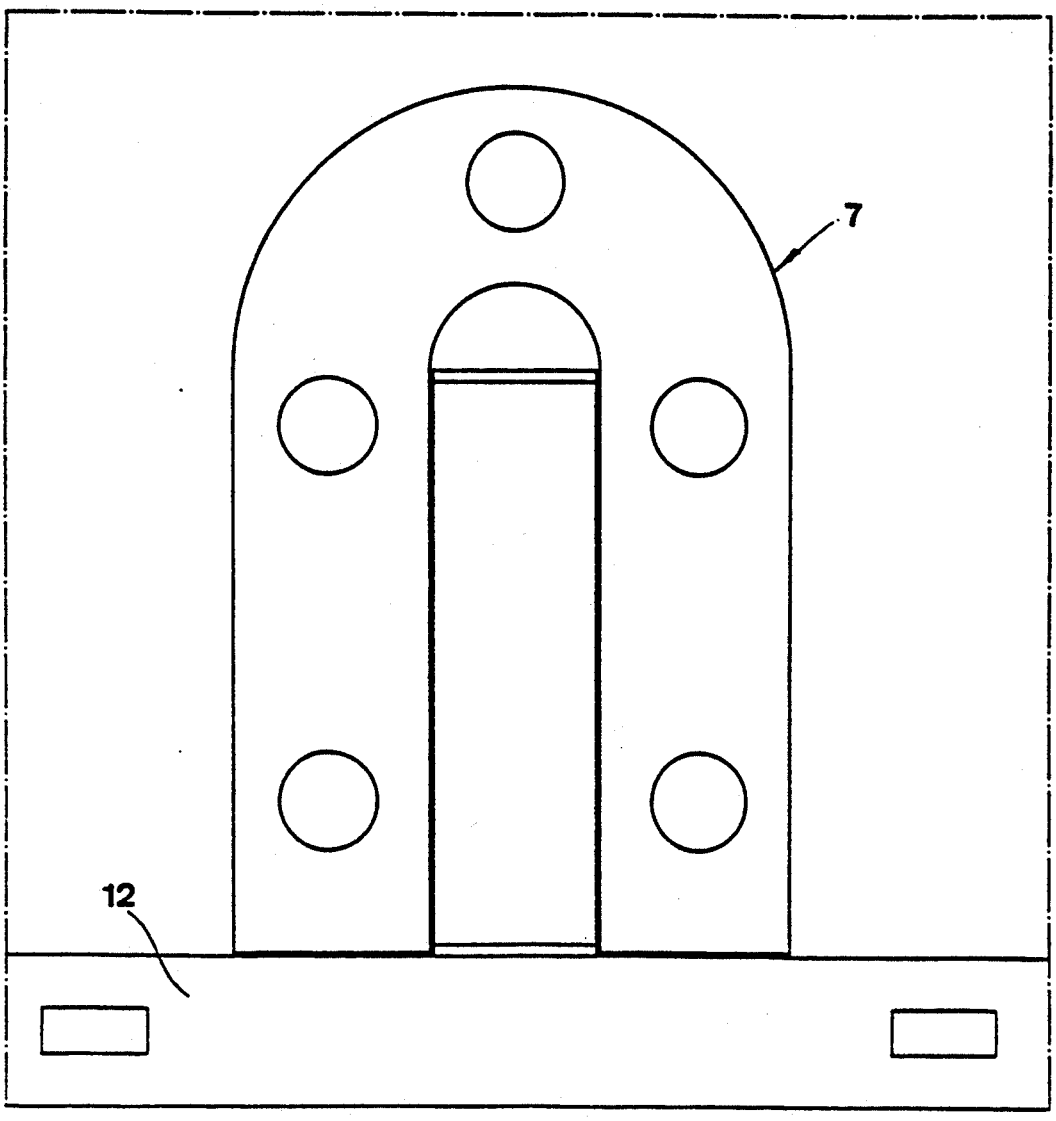
FIG. 5 is a view from above of a portion of the lid.

As it appears from FIG. 4, the edge flange 10 of the lid has in the region of the locking members 15 cuttings 35 for allowing passage of the locking member 15. Furthermore, the upper edge of the wall arrangement 2 is in the region of the recesses 14 provided with countersinks 36 so as to allow the movement of the locking member 15.

The container described is used in the following way: The wall arrangement 2 is applied partially unfolded on the bottom member 1. After that the wall arrangement is further unfolded, so that the locking portions 17 of the bottom member 1 are introduced into the recesses 18 of the wall arrangement and so that the lower edges of the wall arrangement finally become located in the countersinks 19 of the bottom member. The container may after that be provided with suitable goods, whereupon the lid 3 is applied upon the wall arrangement. The locking members 15 of the locking devices 7 are then by means of the springs 25 brought to their releasing second positions, so that the locking portions 16 of the locking members will be located outside the wall arrangement when the lid is applied thereon. The locking members are next manually actuated through the portions 24, so that they are pushed into their first positions, while the locking portions 16 enter into the recesses 14 of the wall arrangement and fix the lid. The stops 30 of the locking members will during insertion of the latters pass the locking portions 29 of the operating members 28, which portions assume their locking positions according to FIG. 2 and 3 and are maintained therein by influence of the spring 31. When the lid afterwards shall be removed, the operating member 28 are to be manually actuated, so that the locking portions 29 are lifted out of the engagement with the stops 30 of the locking members, and the springs 25 pull the locking members to their second positions out of the engagement with the recesses 14.

If the container then shall be folded, the wall arrangement 2 is released from the bottom member 1 by lifting and folding inwardly of the divided and hinged wall portions 4, 5. The wall arrangement gets so the character of a flat package, which in a way appearing from FIG. 2 may be evenly placed upon the bottom member 1 inside the upwardly projecting edge flange 11 thereof. The lid 3 will after that be applied on the folded wall arrangement. The locking member 15 are then again manually pressed into their positions and they will with their locking portions 16 enter into the recesses 8 of the bottom member 1, so that the lid 3 and the bottom member 1 are locked to the wall arrangement located therebetween. The package obtained and held together is extremely compact and easy to transport.

The invention is of course not restricted to the embodiment described. Although the locking means 7 on the lid 3 in the exemplified embodiment have been defined to cooperate with particular locking means in the form of recesses 8 in the bottom member 1, this is not necessary. The recesses 8 or the like may be omitted in an embodiment where the locking means 7 were arranged to grasp under the bottom member 1. Furthermore, it would be possible to arrange locking means which were equivalent to the ones designed by 7 on the bottom member 1 and such locking means would then be arranged to cooperate with the lid for interlocking these and the bottom member 1; these locking means would then also advantageously be adapted to interlock the bottom member 1 and the wall arrangement 2 in the unfolded state of the container, and further locking means would be required for interlocking the lid 3 and the wall arrangement 2. Finally, it should be mentioned that the wall arrangement may be foldable in another way than shown in the example. The walls of the wall arrangement could for example be totally separable from each other instead of being hingedly interconnected. It would also be possible that the walls of the wall arrangement were hingedly connected to the bottom member, so that folding of the wall arrangement will be obtained by folding the walls downwardly and inwardly over the bottom member. Even other modifications will be possible within the scope of the spirit of the invention.

I claim:

1. A foldable container comprising a bottom member (1), a foldable wall arrangement (2) and a lid (3), characterized in that a locking arrangement included in the container and having locking means (7, 8) on one of said lid and bottom member is arranged to interlock the lid and the bottom member in the folded state of the container, and that the lid and the bottom member form a space (9) therebetween in the interlocked state, in which space the folded wall arrangement (2) may be received, and that the lid and the bottom member form a substantially closed box in the interlocked state, the volume of said box being mainly predetermined by the location of the locking means and their mutual engagement and substantially smaller than the volume of the container in the unfolded state thereof, and that the wall of the box is formed by edge flanges (10, 11) of the lid and the bottom member, and that a recess (8) in the bottom member is formed by folding out a portion (17) of the edge flange (11) of the bottom member, and that the portion folded out forms a further locking means, which by cooperating with corresponding locking means (18) on the wall arrangement serves to hold the wall arrangement and the bottom member together in the unfolded state of the container.

2. A container according to claim 1, characterized in that the locking means (7) on the lid (3) is arranged to interlock the lid and the wall arrangement (2) in the unfolded state of the container by entering into engagement with corresponding locking means (14) on the wall arrangement.

3. A container according to claim 1, characterized in that the locking means (7) on the lid comprise at least a locking device with a moveable locking member (15).

4. A container according to claim 3, characterized in that the locking means (8) on the bottom member comprise at lest a recess for receiving a portion (16) of the locking member (15).

5. A container according to claim 2, characterized in that the locking means (14) on the wall arrangement comprise at least a recess for receiving a portion (16) of the locking member.

6. A container according to claim 3, characterized in that the locking member (15) is moveable with respect to a body (20) of the locking device disposed in substantially parallel relation to the plane of the lid between a first position, in which a portion (16) of the locking member is receivable in a recess (14, 8), and a second position, in which said locking member portion is located outside the recess.

7. A container according to claim 6, characterized in that the locking member (15) is urged by means of at least a first spring (25) towards one of its first and second positions.

8. A container according to claim 7, characterized in that an operating member (28) is pivotally mounted with respect tot he body about an axle (27) directed substantially transversely to the direction of movement of the locking member and arranged to lockingly cooperate with the locking member so as to hold it in one of its first and second positions against the action of the first spring.

9. A container according to claim 8, characterized in that the operating member (28) is by means of at least a second spring (31) influenced towards its locking position, and that the operating member may be pivoted by manual influence from its locking position so as to release the locking member.

10. A container according to claim 7, characterized in that the first spring (25) is arranged to influence the locking member (15) towards its second position and that the locking member may be returned to its first position against the action of the first spring.

11. A foldable container comprising a bottom member (1), a foldable wall arrangement (2) and a lid (3), characterized in that a locking arrangement included in the container and having locking means (7, 8) on one of said lid and bottom member is arranged to interlock the lid and the bottom member in the folded state of the container, and that the lid and the bottom member form a space (9) therebetween in the interlocked state, in which space the folded wall arrangement (2) may be received, and that the locking means (7) on the lid comprise at least a locking device with a moveable locking member (15), and that the locking member (15) is moveable with respect to a body (20) of the locking device disposed in substantially parallel relation to the plane of the lid between a first position, in which a portion (16) of the locking member is receivable in a recess (14, 8), and a second position, in which said locking member portion is located outside the recess and that the locking member (15) is urged by means of at least a first spring (25) towards one of its first and second positions, and that an operating member (28) is pivotally mounted with respect to the body about an axle (27) directed substantially transversely to the direction of movement of the locking member and arranged to lockingly cooperate with the locking member so as to hold it in one of its first and second positions against the action of the first spring.

12. A container according to claim 11, characterized in that the lid and the bottom member form a substantially closed box in the interlocked state, the volume of said box being mainly predetermined by the location of the locking means and their mutual engagement and substantially smaller than the volume of the container in the unfolded state thereof.

13. A container according to claim 12, characterized in that the wall of the box is formed by edge flanges (10, 11) of the lid and the bottom member.

14. A container according to claim 11, characterized in that the locking means (7) on the lid (3) is arranged to interlock the lid and the wall arrangement (2) in the unfolded state of the container by entering into engagement with corresponding locking means (14) on the wall arrangement.

15. A container according to claim 11, characterized in that the locking means (8) on the bottom member comprise at least a recess for receiving a portion (16) of the locking member (15).

16. A container according to claim 14, characterized in that the locking means (14) on the wall arrangement comprise at least a recess for receiving a portion (16) of the locking member.

17. A container according to claim 13, characterized in that a recess (8) in the bottom member is formed by folding out a portion (17) of the edge flange (11) of the bottom member, and that the portion folded out forms a further locking means, which by cooperating with corresponding locking means (18) on the wall arrangement serves to hold the wall arrangement and the bottom member together in the unfolded state of the container.

18. A container according to claim 11, characterized in that the operating member (28) is by means of at least a second spring (31) influenced towards its locking position, and that the operating member may be pivoted by manual influence from its locking position so as to release the locking member.

19. A container according to claim 11, characterized in that the first spring (25) is arranged to influence the locking member (15) towards its second position and that the locking member may be returned to its first position against the action of the first spring.

20. A foldable container comprising a bottom member (1), a foldable wall arrangement (2) and a lid (3), characterized in that a locking arrangement included in the container and having locking means (7, 8) on one of said lid and bottom member is arranged to interlock the lid and the bottom member in the folded state of the container, and that the lid and the bottom member form a space (9) therebetween in the interlocked state, in which space the folded wall arrangement (2) may be received, and that the locking means (7) on the lid comprise at least a locking device with a moveable locking member (15), and that the locking member (15) is moveable with respect to a body (20) of the locking device disposed in substantially parallel relation to the plane of the lid between a first position, in which a portion (16) of the locking member is receivable in a recess (14, 8), and a second position, in which said locking member portion is located outside the recess and that the locking member (15) is urged by means of at least a first spring (25) towards one of its first and second positions, and that the first spring (25) is arranged to influence the locking member (15) towards its second position and that the locking member may be returned to its first position against the action of the first spring.

21. A container according to claim 20, characterized in that the lid and the bottom member form a substantially closed box in the interlocked state, the volume of said box being mainly predetermined by the location of the locking means and their mutual engagement and substantially smaller than the volume of the container in the unfolded state thereof.

22. A container according to claim 21, characterized in that the wall of the box is formed by edge flanges (10, 11) of the lid and the bottom member.

23. A container according to claim 20, characterized in that the locking means (7) on the lid (3) is arranged to interlock the lid and the wall arrangement (2) in the unfolded state of the container by entering into engagement with corresponding locking means (14) on the wall arrangement.

24. A container according to claim 20, characterized in that the locking means (8) on the bottom member comprise at least a recess for receiving a portion (16) of the locking member (15).

25. A container according to claim 23, characterized in that the locking means (14) on the wall arrangement comprise at least a recess for receiving a portion (16) of the locking member.

26. A container according to claim 22, characterized in that a recess (8) in the bottom member is formed by folding out a portion (17) of the edge flange (11) of the bottom member, and that the portion folded out forms a further locking means, which by cooperating with corresponding locking means (18) on the wall arrangement serves to hold the wall arrangement and the bottom member together in the unfolded state of the container.

27. A container according to claim 20, characterized in that an operating member (28) is pivotally mounted with respect to the body about an axis (27) directed substantially transversely to the direction of movement of the locking member and arranged to lockingly cooperate with the locking member so as to hold it in one of its first and second positions against the action of the first spring, and that the operating member (28) is by means of at least a second spring (31) influenced towards its locking position, and that the operating member may be pivoted by manual influence from its locking position so as to release the locking member.

* * * * *